US006898805B1

(12) United States Patent
Truong et al.

(10) Patent No.: US 6,898,805 B1
(45) Date of Patent: May 31, 2005

(54) UNDERWEAR WITH TRIMLESS SEAM

(75) Inventors: Tony N. Truong, Winston-Salem, NC (US); Teresa Thompson, Winston-Salem, NC (US)

(73) Assignee: Sara Lee Corporation, Winston-Salem, NC (US)

( * ) Notice: Subject to any disclaimer, the term of this patent is extended or adjusted under 35 U.S.C. 154(b) by 387 days.

(21) Appl. No.: 10/195,208

(22) Filed: Jul. 15, 2002

(51) Int. Cl.[7] ..... A41B 9/02
(52) U.S. Cl. ..... 2/400; 2/403
(58) Field of Search ..... 2/400–408, 243.1, 2/79, 73, 78.1–78.3, 228, 238; 450/100–106; 604/385.01–402

(56) References Cited

U.S. PATENT DOCUMENTS

| | | | | |
|---|---|---|---|---|
| 1,444,894 A | | 2/1923 | Winkelmann | |
| 1,746,541 A | | 2/1930 | Loeb | |
| 1,843,494 A | | 2/1932 | Pilatsky | |
| 1,926,950 A | | 9/1933 | Kucera | 112/147 |
| 1,930,665 A | | 10/1933 | Sailer | 112/147 |
| 1,984,875 A | * | 12/1934 | Heyn | 2/401 |
| 1,988,140 A | | 1/1935 | Sailer | 112/147 |
| 2,011,512 A | | 8/1935 | Carmichael et al. | 112/262 |
| 2,012,879 A | * | 8/1935 | Kneibler | 2/403 |
| 2,028,773 A | | 1/1936 | Galkin | 112/147 |
| 2,062,161 A | * | 11/1936 | Chatfield | 2/405 |
| 2,114,634 A | * | 4/1938 | Jean | 2/403 |
| 2,133,225 A | | 10/1938 | Goodwin | 112/147 |
| 2,149,755 A | | 3/1939 | Ackerman | 112/147 |
| 2,191,169 A | * | 2/1940 | Katz | 2/404 |
| 2,239,972 A | * | 4/1941 | Rauser | 2/403 |
| 2,384,165 A | * | 9/1945 | Goldfarb et al. | 2/404 |
| 2,462,508 A | | 2/1949 | Kneibler | 2/224 |
| 2,493,822 A | * | 1/1950 | Meggs | 602/67 |
| 2,494,261 A | | 1/1950 | Owenby | 2/224 |
| 2,571,497 A | | 10/1951 | Senderowitz | 2/225 |
| 2,715,376 A | | 8/1955 | Hengstler | 112/147 |
| 2,854,934 A | | 10/1958 | Boser | 112/147 |
| 3,088,121 A | | 5/1963 | Stedman et al. | 2/226 |
| 3,844,282 A | * | 10/1974 | King | 602/67 |
| 4,184,439 A | | 1/1980 | Schulz | 112/147 |
| 4,765,172 A | | 8/1988 | Seese et al. | 72/322 |
| 5,713,292 A | | 2/1998 | Wong | 112/441 |
| 5,797,338 A | | 8/1998 | Stone | 112/475.13 |
| 5,906,169 A | | 5/1999 | Martelli | 112/137 |
| 5,950,554 A | | 9/1999 | Wong | 112/475.09 |
| 6,070,542 A | | 6/2000 | Wong | |
| 6,079,343 A | | 6/2000 | Wong | |
| 6,120,489 A | | 9/2000 | Johnson et al. | |

* cited by examiner

*Primary Examiner*—Gloria M. Hale
(74) *Attorney, Agent, or Firm*—Womble Carlyle Sandridge & Rice, PLLC

(57) ABSTRACT

An underwear construction including multiple fabric panels that are adjoined by trimless seams.

8 Claims, 5 Drawing Sheets

UNDERWEAR WITH TRIMLESS SEAM

FIELD OF THE INVENTION

The present invention relates generally to male undergarments, and, more particularly, to an undergarment brief or shorts having a trimless seam construction.

BACKGROUND OF THE INVENTION

Various forms of male undergarments have been developed over the ages. In particular, in more modern times, two types have become most widely known: underwear briefs, sometimes referred to as "jockey shorts," and a loosely fitting shorts known as "boxers."

Men's briefs are generally constructed with one or more trunk panels, and overlapping front panels. The briefs known in the art have commonly been constructed so that the trunk panel is joined to the overlapping front panels along a pair of vertical, spaced-ap art, and generally parallel seams. The overlapping front panels typically define a singular fly opening for access through the outermost panel to the penis for purposes of urination. Because use of the fly formed by the front panels places repeated stress on the scams, the seams must be reinforced. To ensure adequate reinforcement of these seams, a trim strip formed of folded material is stitched over the seam. While the trim strip strengthens the seam, a ridge, or raised area is created along each of the front seams. The resulting briefs are considered by some consumers to be less than aesthetically pleasing to the sight or touch. Further, the material costs for the trim strips, and the added labor costs associated with the manufacturing step of stitching the trim strips to the briefs add substantially to the total costs of producing the briefs. What is needed in the art is an underwear seam construction that is sufficiently strong to accommodate the stress associated with normal wear, but is more aesthetically pleasing and cheaper to manufacture than a brief constructed with a trim strip. There has not heretofore, however been an alternative to the use of trim strips for sufficient reinforcement of the seams.

SUMMARY OF THE INVENTION

The present invention is directed to a man's underwear construction that addresses the problems associated with the reinforcing trim strips. As used herein, the term "underwear" is intended to encompass shorts, drawers, skivvies, jockey shorts, boxer shorts, briefs, long underwear, and variations thereof. In one embodiment of the present invention, the underwear construction includes a trunk panel, and inner and outer front panels that are joined together along a plurality of edges, or seams.

The panels forming the underwear of the present invention are desirably of knitted fabric, however the invention is not limited to fabric of a knitted construction. Nevertheless, the knitted fabric of the preferred embodiment is formed from yarns of 100% or less cotton; the fabric also could be knitted or woven from blended natural and synthetic yarns.

In the first embodiment, the trunk panel is the largest single panel forming the underwear and has an upper edge, lower edge, and opposed side edges. The opposed side edges have concave cutouts formed therealong that terminate at the bottom edge. The concave portions, when attached to front panels, define leg openings.

The inner and outer front panels are identically formed. Each panel has top and bottom edges and opposed side edges, where the bottom edges are joined to the lower edge of the trunk panel and the opposed side edges are joined along their uppermost portions to the opposed side edges of the trunk panel. One of the opposed side edges on each panel is arcuately-shaped to define a fly and is unjoined along at least some portion to form a fly opening.

To form the underwear construction, the outer front panel is obversely placed on top of the inner front panel so that a singular fly opening is created in the outer front panel; i.e., the arcuate edge of the outer front panel will be opposed the arcuate edge of the inner front panel. A trimless seam is then formed by folding under about one-quarter inch of one free edge of the trunk panel and overlying it on about one-quarter inch of the free edges on one side of the inner and outer front panels. The overlying portions are then sewn together using a bottom cover stitch extending the length of the seam. The process is then repeated for the opposed seam. The finished seam is flatter and smoother to the touch than a conventional seam with an applied trim strip. Also, the garment is more inexpensively and efficiently manufactured because the trim piece is eliminated and the additional manufacturing step is no longer necessary.

These and other aspects of the present invention will become apparent to those skilled in the art after a reading of the following description of the preferred embodiment when considered with the drawings.

DESCRIPTION OF THE PREFERRED EMBODIMENTS

Figure 1:
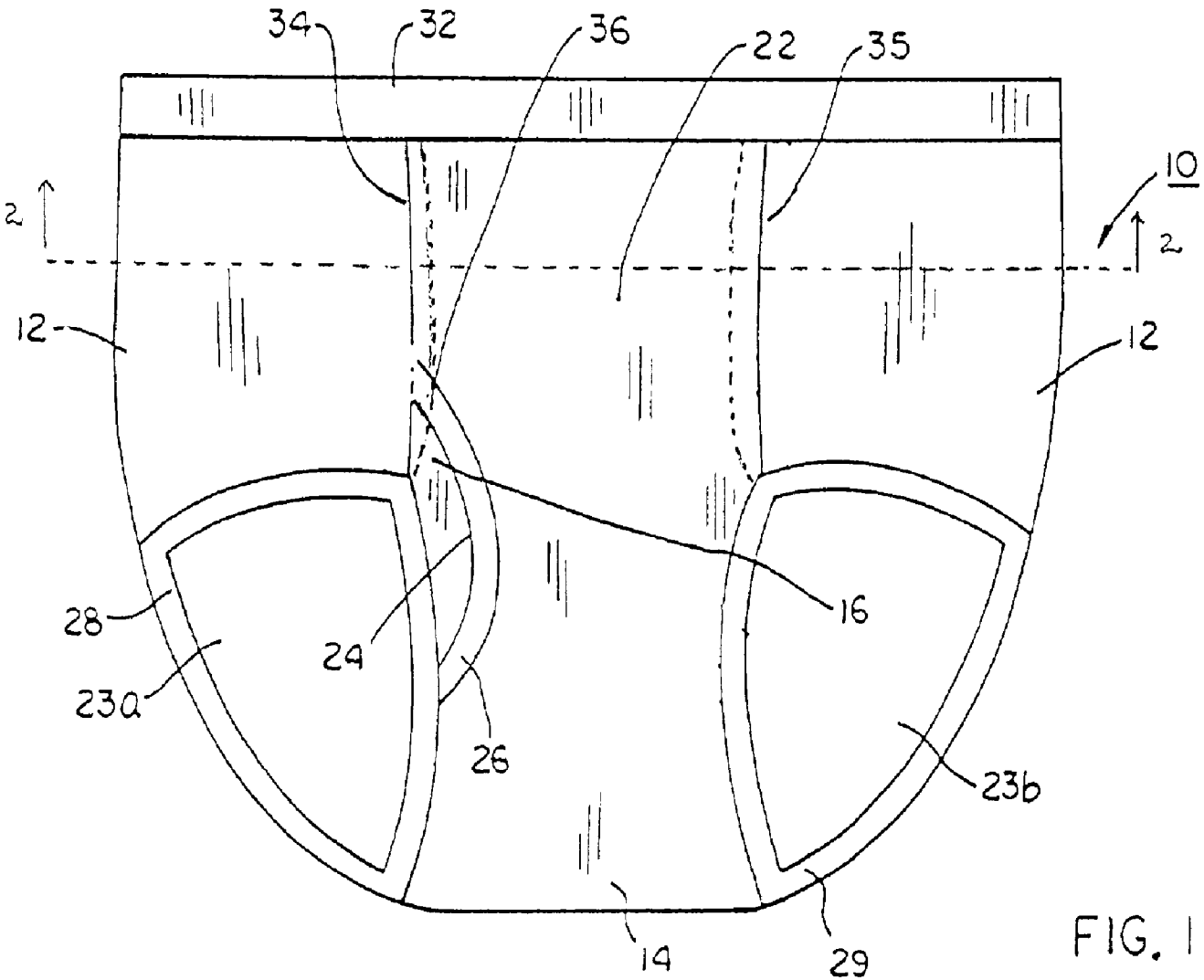
FIG. 1 is a front view of the men's underwear brief of the present invention.
Figure 2A:
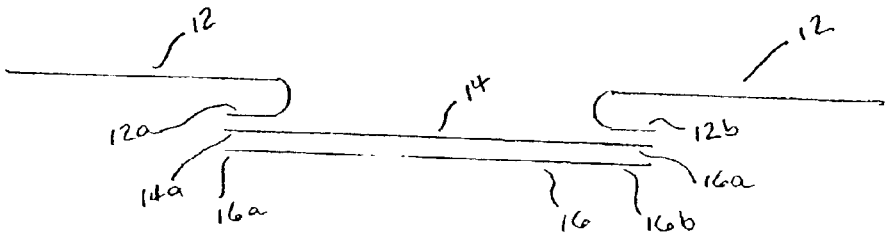
FIG. 2A is an exploded cross-sectional view of the trimless seam construction for the brief of FIG. 1, taken along line 2—2.
Figure 2B:
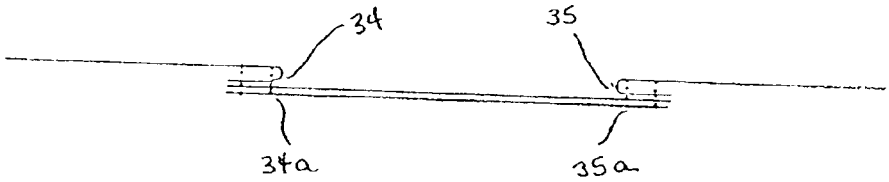
FIG. 2B is an as-constructed cross-sectional view of the trimless seam construction of FIG. 2A.
Figure 3:
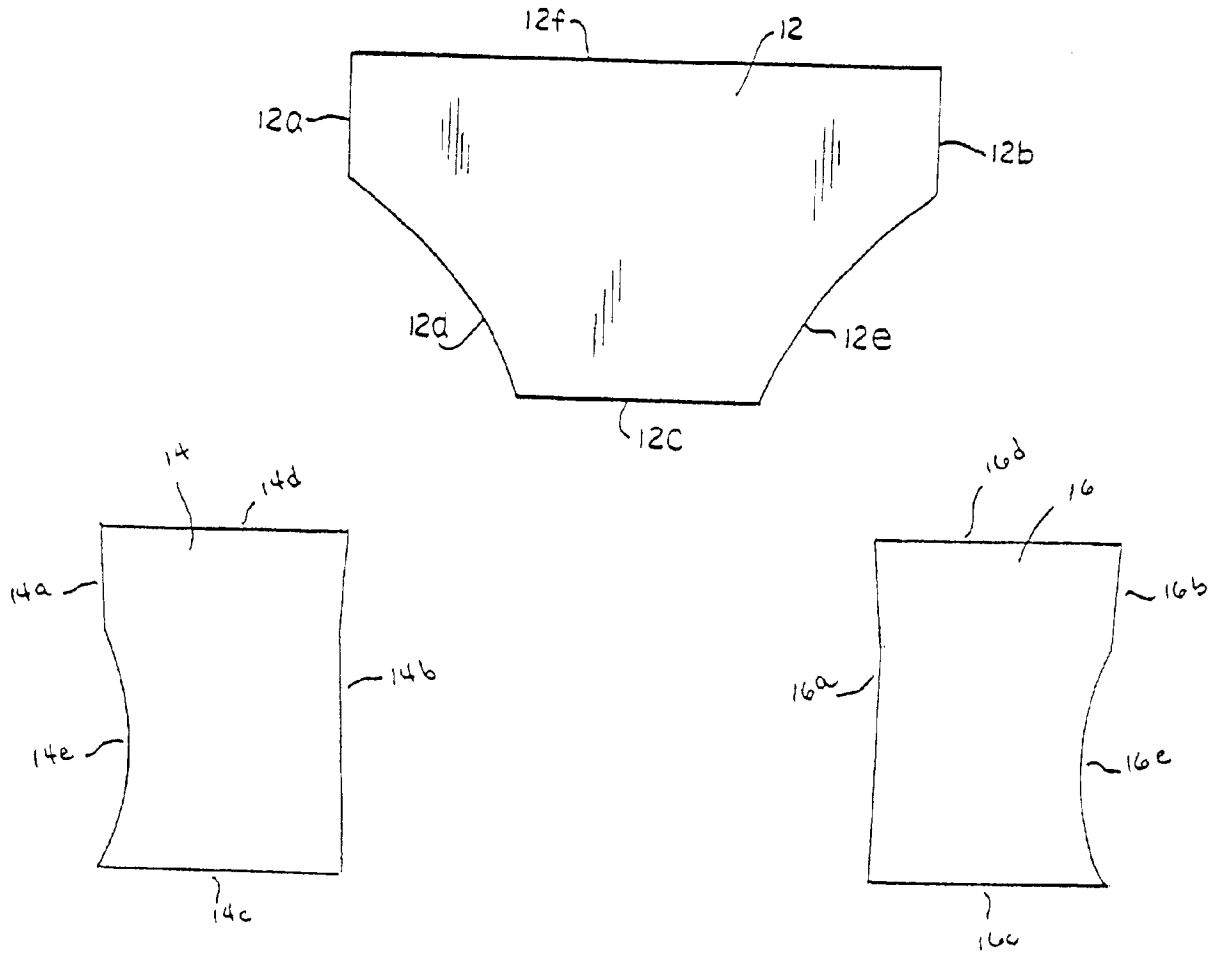
FIG. 3 is a front view of the inner and outer panel construction of the present invention.

Referring now to FIGS. 1 through 3, it will be understood that the illustrations are for the purpose of describing a preferred embodiment of the invention and are not intended to limit the invention thereto. FIG. 1 is a front schematic view of a pair of men's underwear briefs formed according to the present invention, shown generally as 10. In one embodiment, the briefs are shaped in conventional fashion for "jockey" type briefs, although the invention is not limited to a particular brief construction.

As best illustrated in FIG. 3, in one embodiment, the briefs 10 are formed from three panels that are joined together along specified seams. The panels are each formed from a single knitted fabric of yarns that are 100 percent cotton; however, the fabric forming the panels are not limited to a 100 percent cotton structure, and are not limited to knitted fabric.

FIG. 3 best illustrates the shapes of the three panels used to form the briefs before they are joined together. As those skilled in the art will appreciate, the number of panels is not critical so long as a fly is formed by overlapping front panels on one side or the other of the briefs. The three panels comprise a trunk panel 12, an inner front panel 16, and an outer front panel 14. Inner front panel 16 and outer front panel 14 are identically formed, although this is for convenience of manufacture and is not a requirement of the construction. As will be understood, however, the front panels are obversely positioned one atop the other in forming the underwear construction of the present invention, so that the arcuate edge 14*e* of the outer front panel is opposite the arcuate edge 16*e* of the inner front panel.

Trunk panel 12 covers the trunk, or buttocks, of the wearer of the brief and extends around the waist to the front of the briefs. Trunk panel 12, inner panel 16, and outer panel 14 are sewn together along their bottom edges 12*c*, 14*c*, and 16*c* to form a lower seam. Trunk panel 12 wraps around the front of the briefs for attachment to inner front panel 16 and outer front panel 14. Specifically, edge 12*a* of trunk panel 12 is attached to edges 16*a* and 14*a* of inner front panel 16 and outer front panel 14, respectively, along a trimless seam that is discussed in greater detail below. Similarly, edge 12*b* of trunk panel 12 is attached to edges 16*b* and 14*b* of inner front panel 16 and outer front panel 14, also along a trimless seam. As will be understood, when panels 12, 14, and 16 are attached as described herein, edges 12*d* and 12*e* to 14*e* and 16*e*, respectively, create leg openings 23*a*, 23*b* for the briefs, as shown in FIG. 1.

Generally, the panels of a conventional underwear construction are aligned and a binding, or trim strip, is sewn over the panel junctures to securely join and reinforce the edges of the panels, creating an acceptable appearance and comfortable feel. As used herein, the terms "binding" or "trim strip" refer to a strip of like material that is placed over the juncture of adjoining panels or along the exposed unfinished edges of a panel.

Referring now to FIGS. 2A and 2B, the trimless seam construction of the present invention is best seen. For ease of illustration, FIG. 2A is an exploded view of FIG. 2B. While a particular sequence of steps is described to illustrate the construction, the order of steps is not limited thereto. The joinder of panels 12, 14, and 16 begins with positioning outer panel 14 over inner panel 16. Because the two panels, albeit reversed, are similarly dimensioned, edges 14*a* and 14*b* of panel 14 will align with edges 16*a* and 16*b*, respectively, of panel 16, along the uppermost lengths of those edges. Thus, panels 14 and 16 are unjoined at this stage, but substantially overlie one another.

Opposing side edges 12*a* and 12*b* of trunk panel 12 are individually folded under, one at a time, by about ¼ inch so that the finished underwear construction will have a smooth, flat seam. While a fold of about ¼ inch is desirable, those skilled in the art will appreciate that considerable variation in the dimension of the fold is permissible, so long as excess material does not hinder the construction and wear of the undergarment. Side edges 12*a* and 12*b* may be manually folded or automatically folded using known sewing or embroidery machine folders and feeding accessories.

Once edges 12*a* and 12*b* have been folded over, they are positioned one at a time to overlap about ¼ inch of the free edges 14*a*, 16*a* or 14*b*, 16*b*, respectively. With the three panels so positioned, they are fed beneath the head of a multi-needle sewing machine where a cover stitch 34*a*, 35*a* is applied. In a preferred embodiment, as shown in FIG. 2B, a two-needle, bottom cover stitch is sewn through the overlying panels to create, the smooth, trimless seams 34, 35. While a conventional bottom cover stitch is described herein, those skilled in the textile arts will appreciate that there are a number of other stitch types that are acceptable and suitable substitutes. The needles of the sewing head are 75 millimeters, and the thread used to form the cover stitch is a 180 denier, textured polyester. Alternatively, a range of needle sizes and numbers may suitably form the cover stitch of the trimless scam. Also, thread formed of other materials may be used.

Because the trunk panel 12 edges 12*a* and 12*b* are folded under and positioned over the front panel side eges 14*a*, 14*b*, 16*a*, and 16*b*, the finished undergarment not only has an pleasing hand and visually appealing construction, but does not require the additional reinforcement of bulky and expensive trim strips that conventional briefs require.

Returning to FIGS. 1 and 3, inner panel 16 is attached along its lower edge 16*c* to the bottom edge 12*c* of trunk panel 12. Likewise, outer panel 14 is attached along its lower edge 14*c* to bottom edge 12*c* of trunk panel 12. Alternatively, edge 16*c* of inner panel 16 may be dimensioned so that it does not extend completely down to edge 12*c* and may be left unjoined so that a lower opening between outer panel 14 and inner panel 16 is formed therebetween.

As can be seen in FIG. 1, when the undergarment 10 is so constructed with the outer and inner panels securely overlapped, a singular fly 24 is created on one side of outer panel 14.

Returning to FIG. 1, a waistband 32 of elastic fabric is sewn around the upper periphery of the briefs to aid in holding the briefs in proper alignment about the torso. Additionally, bindings 28, 29, and 36 are secured around the leg openings 23*a* and 23*b*, and around the fly 24.

Figure 4:
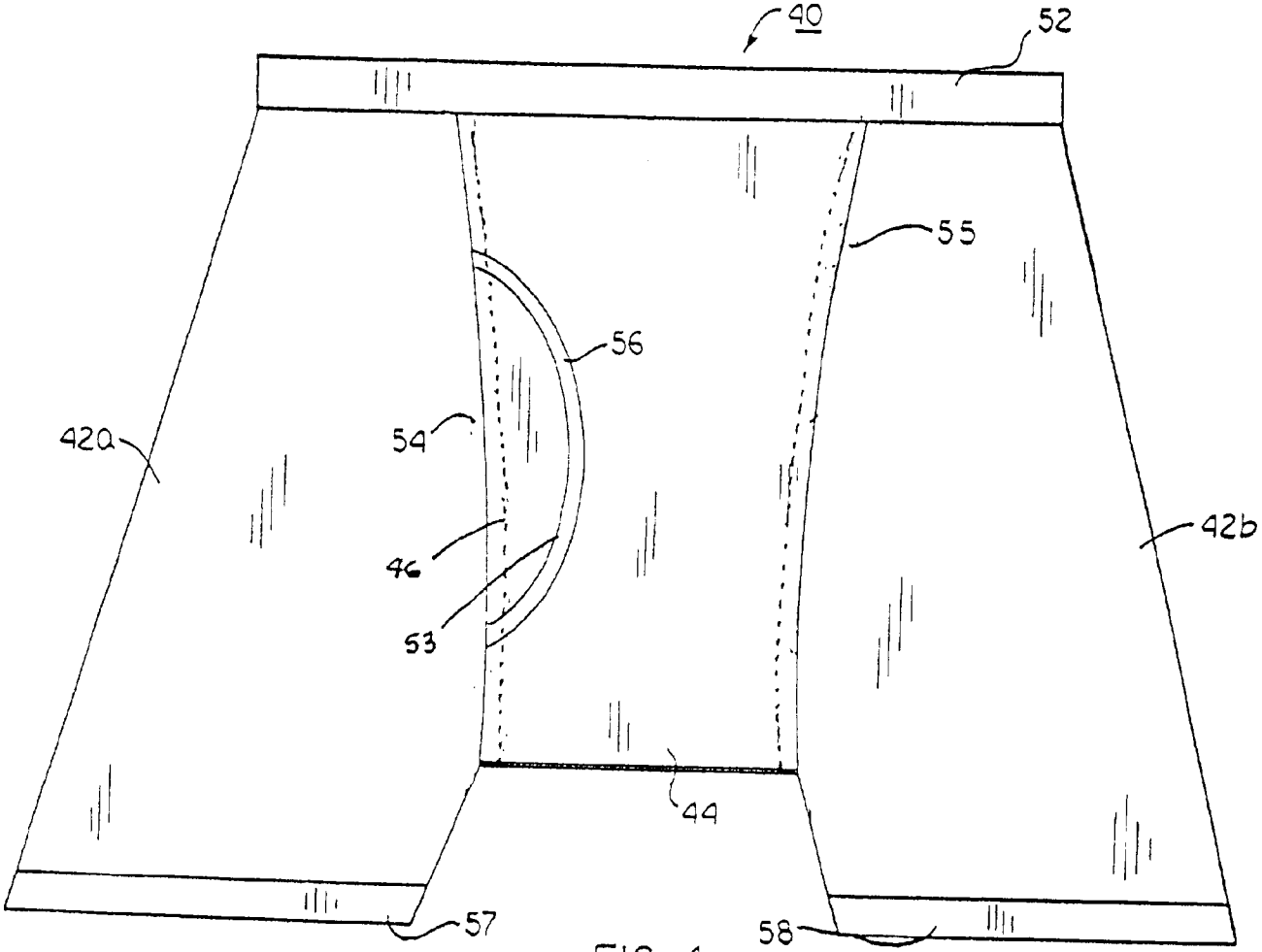
FIG. 4 is a front view of the men's boxer shorts of the present invention.

A second embodiment of the present invention provides a men's underwear formed as boxer shorts, shown generally as 40 in FIG. 4. The overlying arrangement of the inner panel 46 and the outer panel 44 is the same as that of the briefs 10, with a singular ly opening 53 formed by the unattached arcuate edge 44*d* of outer panel 44. The principal differences between the construction of the briefs and the construction of the boxer shorts are the number and shape of panels.

Figure 5:
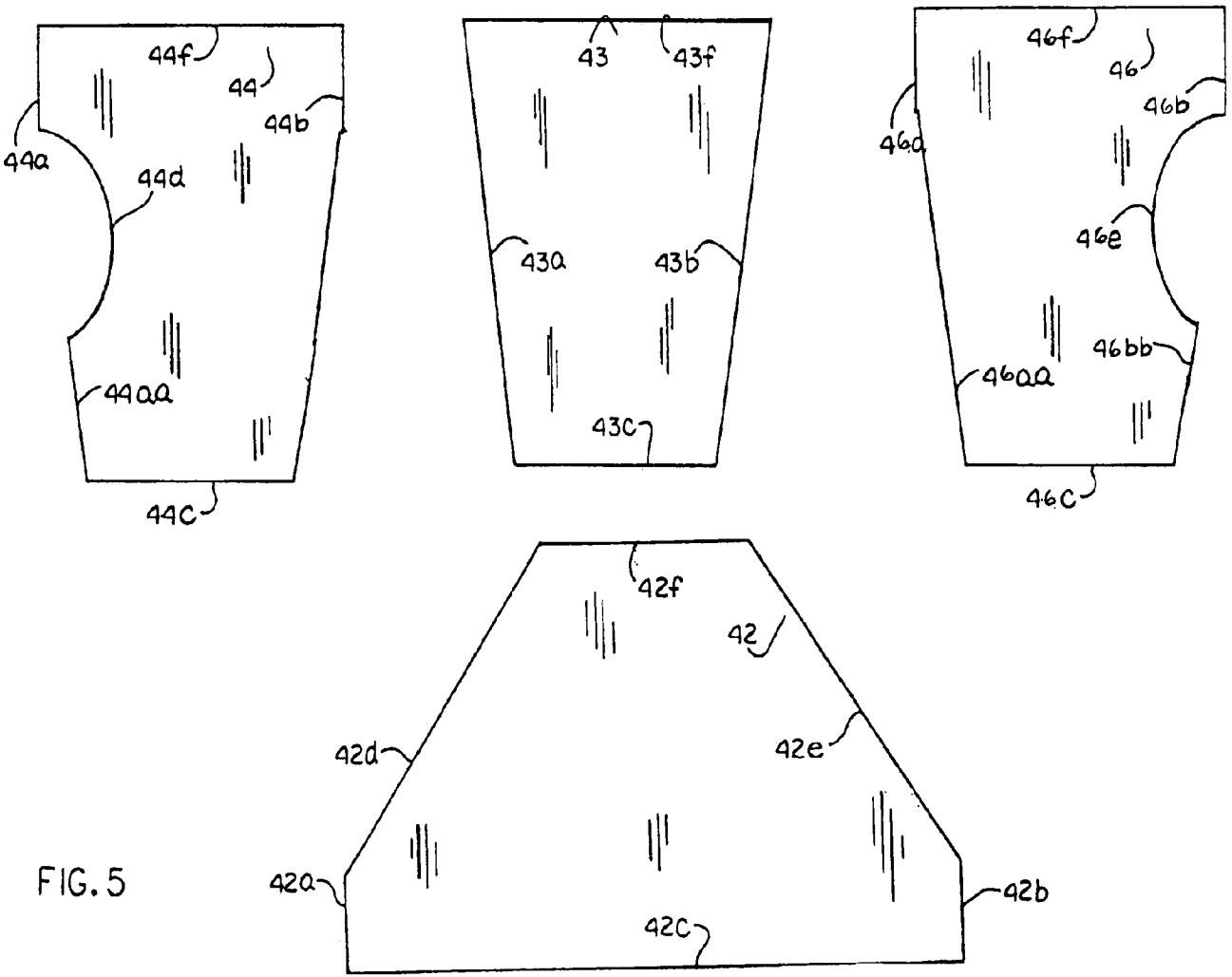
FIG. 5 is an plan view illustrating the panels that form the boxer shorts of FIG. 4.

Referring to FIGS. 4 and 5, boxer shorts 40 are formed from five panels, consisting of four different shapes. There are two leg panels 42 that are identically formed to form the left and right leg portions of the boxer shorts 40. As can be seen in FIG. 5, and as will be readily understood by those skilled in the art, the trunk portion of the boxer shorts 40 is formed by a rear panel 43 that is joined along edge 43*a* to an edge 42*d* of one leg portion and along edge 43*b* to an edge 42*e* on the opposed leg portion. Edges 42*a* and 42*b* on each leg portion 42 are joined together to complete the leg construction.

Outer panel 44 and inner panel 46 are identically formed, but observably positioned with respect to one another, similar to the first embodiment for the briefs. Thus arcuate edge 44*d* of panel 44 is opposite edge 46*e* of panel 46. Bottom edges 46*c* of inner panel 46, bottom edge 44*c* of outer panel 44, bottom edge 42*f* of panel 42, and edge 43*c* of the rear panel 43 are joined together to form the bottom seam of the boxer shorts seat portion. Edge 46*a* and edge 46*aa* of inner panel 46 is joined to edge 42*d* on one leg portion and edges 46*b* and 46*bb* of inner panel 46 are joined along the upper and lower portions of edge 42*e* on the opposed leg portion. Similarly, edges 44*a* and 44*aa* of the outer panel 44 are attached along the upper and lower portions of edge 42*d* on one leg portion and edge 44*b* is joined to edge 42*e* on the opposed leg portion. So constructed, the boxer shorts 40 are formed with trimless seams 54, 55 by the same overlying and folded construction shown in FIGS. 2A and 2B. As seen in FIGS. 1 and 4, the most substantial difference between trimless seams 34, 35 and 54, 55 is the length of the seams.

Referring again to FIGS. 4 and 5, bindings 57 and 58 may be applied along edges 42*c* of each leg opening bottom. Similarly, binding 56 may be attached along the fly opening 53. An elastic waistband 52 is desirably also attached around the upper periphery of the boxer shorts, namely, upper edges 44*f*, 43*f*, 46*f*, and 42*c*.

Certain modifications and improvements will occur to those skilled in the art upon a reading of the foregoing description. It should be understood that all such modifications and improvements have been deleted herein for the sake of conciseness and readability but are properly within the scope of the following claims.

We claim:

1. An underwear construction, comprising:

(a) a trunk panel having an upper edge, a lower edge, and opposed side edges, each of the opposed side edges having concave portions formed therealong at least some portion of the opposed side edge and terminating at the bottom edge; and (b) inner and outer fronts panels having top and bottom edges and opposed side edges, wherein each of the opposed side edges having an upper portion, and wherein the bottom edge is joined to the lower edge of the trunk panel and the opposed side edges are joined along their upper portions to the opposed side edges of the trunk panel by trimless seams.

2. The underwear construction of claim 1 wherein each of the trimless seams comprises a side edge of the trunk panel folded under, wherein the folded edge is cover stitched atop one of the opposed side edges of an inner panel and one of the opposed side edges of an outer panel.

3. The underwear construction of claim 2 wherein said trimless seam is bottom cover stitched.

4. The underwear construction of claim 1 further including an elastic waistband stitched around the periphery of the upper edges of said trunk panel and of said outer panel of the underwear.

5. An underwear construction, comprising:

(a) a trunk panel having an upper edge, a lower edge and opposed side edges;

(b) first and second leg panels, each of said leg panels having a top edge and opposed side edges, wherein each of the opposed side edges having an upper portion, and wherein an opposed side edge of each of said first and second side panels is joined to one of the opposed side edges of said trunk panel; and (c) inner and outer panels having top and bottom edges and opposed side edges, said outer panel overlying the inner panel and joined to the lower edge of the trunk panel and to the upper portions of the opposed side edges of each of the first and second leg panels along trimless seams.

6. The underwear construction of claim 5 wherein each of the trimless seams comprises a side edge of the trunk panel folded under, wherein the folded edge is cover stitched atop one of the opposed side edges of an inner panel and one of the opposed side edges of an outer panel.

7. The underwear construction of claim 6 wherein said trimless seam is bottom cover stitched.

8. The underwear construction of claim 5 further including an elastic waistband stitched around the periphery of the upper edges of said rear panel, first and second leg panels, and inner and outer panels of the underwear.

* * * * *